US009027746B2

(12) United States Patent
Smith

(10) Patent No.: US 9,027,746 B2
(45) Date of Patent: May 12, 2015

(54) CASE WALLET FOR PORTABLE HANDHELD ELECTRONIC DEVICE

(71) Applicant: Daniel R. Smith, Glendale, CA (US)

(72) Inventor: Daniel R. Smith, Glendale, CA (US)

( * ) Notice: Subject to any disclaimer, the term of this patent is extended or adjusted under 35 U.S.C. 154(b) by 0 days.

(21) Appl. No.: 14/488,462

(22) Filed: Sep. 17, 2014

(65) Prior Publication Data

US 2015/0076020 A1 Mar. 19, 2015

Related U.S. Application Data

(60) Provisional application No. 61/879,433, filed on Sep. 18, 2013.

(51) Int. Cl.
*B65D 85/00* (2006.01)
*A45C 11/00* (2006.01)

(52) U.S. Cl.
CPC ..... *A45C 11/00* (2013.01); *A45C 2011/002* (2013.01); *A45C 2011/003* (2013.01)

(58) Field of Classification Search
USPC ..... 206/320, 457, 38, 701, 472, 37, 39
See application file for complete search history.

(56) References Cited

U.S. PATENT DOCUMENTS

| | | | | |
|---|---|---|---|---|
| 8,047,364 | B2 * | 11/2011 | Longinotti-Buitoni | 206/320 |
| 8,695,798 | B2 * | 4/2014 | Simmer | 206/320 |
| 8,720,683 | B2 * | 5/2014 | Mao | 206/320 |
| 8,726,952 | B2 | 5/2014 | Jambunathan et al. | |
| 2009/0114556 | A1 * | 5/2009 | Tai et al. | 206/320 |
| 2009/0194444 | A1 * | 8/2009 | Jones | 206/320 |
| 2014/0034531 | A1 * | 2/2014 | Wang | 206/320 |
| 2014/0091689 | A1 | 4/2014 | Mishan et al. | |

OTHER PUBLICATIONS

CardNinja Ultra-slim Design/Universal Fit, www.cardninja.com, website visited Sep. 16, 2014.
Simple Wallet, http://gosimplewallet.com/collections, website visited Sep. 16, 2014.
TGT Best Sellers, http://tightstore.com/collections/best-sellers, website visited Sep. 16, 2014.

* cited by examiner

*Primary Examiner* — Jacob K Ackun
(74) *Attorney, Agent, or Firm* — Andrus Intellectual Property Law, LLP

(57) ABSTRACT

A case wallet for a handheld electronic device such as a cellphone includes a device casing, a wooden backing piece and a stretchable sleeve. The wooden backing piece and the stretchable sleeve are permanently adhered to a back wall of the device casing, such that the stretchable sleeve is capable of holding credit cards, folded currency or other personal items.

9 Claims, 4 Drawing Sheets

CASE WALLET FOR PORTABLE HANDHELD ELECTRONIC DEVICE

CROSS-REFERENCE TO RELATED APPLICATION

This application claims the benefit of and priority to U.S. Provisional Patent Application No. 61/879,433, filed Sep. 18, 2013, which is hereby incorporated by reference in entirety.

FIELD OF THE INVENTION

A case for a portable handheld electronic device is provided that combines the functionality of device protection and the personal-item-carrying capability of a slim wallet. The disclosed case wallet creates a slim and convenient method for carrying both a portable handheld electronic device (such as those smart phones sold under the trade names iPhone®, Galaxy®, Windows Phone® and Blackberry®, media players such as those sold under the trade name iPod®, and any other personal electronic devices) and personal items (plastic cards, such as credit, debit, driver's license, ID, hotel card key, or other personal items).

BACKGROUND

With the proliferation of portable handheld electronic devices (smart phones, media players, and other small personal electronic devices) many protective cases for these devices have been developed. Some prior art cases combine a portable handheld electronic device protection capability with the personal-item-carrying capability of a wallet, and such prior art cases have been created using a variety of materials (leather, plastics, etc.). For example, many prior art cases offering personal-item-carrying capability have compartments for carrying personal items, such as makeup or plastic cards such as credit cards or IDs. However, such prior art cases offering compartments for carrying personal items are often too bulky to fit easily in a users' pocket or pocketbook. Moreover, it is difficult for a user to access their personal items in such prior art cases.

Some prior art cases have rigid compartments integrated into the case. Problems exist with such prior art cases because they require a user to open a compartment to access their personal items, which is time consuming and cumbersome and requires the use of both hands. Further, such rigid compartments typically have a defined and limited space, and cannot expand or contract to adapt in size to fit more or fewer, or larger or smaller, items. Other prior art cases have a slit or pocket for holding small, flat items, such as credit cards and identification cards. Those cases pose problems for users because it is often difficult to insert and remove cards from those slits, requiring users to hold the case in one hand and to pinch the edge or corner of the card tightly with the other hand in order to force a card into or out of the slit. Moreover, such prior art slits can typically only hold 1 or two cards and are not adaptable to fit other items.

Some prior art cases have attempted to solve this problem by incorporating a ribbon into a slit or pocket that loops along the interior of the pocket, below any personal effects inserted therein, and sticks out the top of the pocket. The user ejects the contents of the pocket by pulling the ribbon, which forces the contents up and out of the pocket. However, the ribbon has problems because it can break or become entangled, and thus become ineffective. Furthermore, ejecting personal effects from such ribbon apparatuses requires two hands, one to hold the device and the other to pull the ribbon.

U.S. Pat. No. 8,726,952 entitled "Wireless Phone Wallet" issuing on May 20, 2014 to Jambunathan et al discloses an adhesively attachable fabric pocket that is adhered to the backside of a cellphone. The pocket has a closed bottom and a thumb notch to help the user place credit cards or folded currency within the fabric pocket. The fabric pocket in the '952 patent does not provide protection for the cellphone, and is also susceptible to failure because of notches or holes cut into the fabric to enable access to credit cards or folded currency or to enable use of the camera.

U.S. Patent Application Publication No. 2014/0091689A1, entitled "Cover Having Wallet Feature for Electronic Devices", filed on Sep. 28, 2012 to Mishan et al. describes a case that provides a cellphone with added protection but requires injection molds for each new cellphone model having different dimensions. The device has a strap or pocket for holding credit cards or folded currency that is passed through slots in a plastic backing and with the ends glued to the plastic components. The glued ends of the strap are a potential point of failure. The strap is also completely open on the bottom and may not be reliably secure for credit cards as the cover is used over long periods of time.

Accordingly, an improved design is needed for portable electronic cases that offers a sleek and slim design that can fit easily into a users' pocket or purse, and that is adaptable to allow a user to store and easily access, such as by using only one hand, a multitude of different items.

SUMMARY

A case wallet is provided having a front side configured to attach to a portable, handheld electronic device, such as a cellphone, and a back side providing a stretchable sleeve to carry personal items, such as credit cards, folded currency, keys, or other small personal effects. The case wallet is designed to be slim yet provides strength and protection for the handheld electronic device. There are no flaps or doors to complicate operation of the handheld electronic device or impede access to personal items. The ejection of personal items from the sleeve of the case wallet can be performed with the flick of a finger or thumb, allowing convenient one hand operation.

The case wallet is comprised of at least three elements. The first element is a device casing for a handheld electronic device, such as the case 4 depicted in FIG. 2. The device case is a standard case sized to fit the handheld device. The casing must have a substantially flat back side, or has at least a portion of the back side that is substantially flat, like a variety of existing cases available on the market. The preferred casing has an elastomeric bumper surrounding the outer, backside edge of the casing for cushioning the handheld electronic device in case it is dropped. The second element is a backing piece, desirably made from a thin wooden board such as 1/16 inch mahogany plywood or basswood plywood. The wooden backing piece has an inside face that adheres to the back of the casing and a decorative outside face on the visible back side of the case wallet.

The third element is a stretchable sleeve that wraps completely around the backing piece and has an open top and a semi-open bottom. The bottom is made semi-open preferably by sewing tacks near the lower corners of the stretchable sleeve so that standard-sized credit cards cannot fit through the opening at the bottom of the sleeve. The semi-open bottom as mentioned allows convenient access to contents stored in the sleeve without the risk of credit cards falling through the bottom. The backing piece has two sleeve indentations along its lateral sides to secure the sleeve in place. It also desirably includes a recessed portion on its inside, non-exposed face corresponding to the location of the sleeve indentations for the purpose of receiving the stretchable sleeve as it wraps around the backing piece and is sandwiched between the back wall of the device casing and the inside, non-exposed face of the backing piece. The stretchable sleeve and the inside, non-exposed face of the backing piece are desirably adhered permanently to the back wall of the device casing with glue applied under pressure such that the stretchable sleeve is sandwiched between the backing piece and the back wall of the casing. Desirably, the elastomeric bumper described above surrounds the sides of the backing piece as well. This sleeve attachment configuration is secure and durable. In addition, this configuration enables to designer to create a multitude of attractive case wallets with exposed portions of the wooden backing piece and the capability to select fabrics with varying decorative patterns and sizes.

The use of the wooden backing piece as the central element for attaching the stretchable sleeve is different from the cover described in the above referenced U.S. Pat. Publication No. 20140091689. The use of wood provides an engineering cost advantage compared with injection molded products inasmuch as the unique size configuration is not dependent on the creation of custom injection molds for new cellphone models. Desirably, the case wallet is constructed with device cases having stock rubber bumpers that are commonly available for the specific cellphone model. The wooden backing piece can be cut on a laser cutter based on a digital file that can be adapted in hours for new cellphone models.

Wrapping the stretchable sleeve completely around the wooden backing piece, and permanently adhering the stretchable sleeve and the wooden backing piece under pressure to the back wall of the device casing, with the stretchable sleeve sandwiched between the back wall and the wooden baking piece, provides a strong design. Desirably, the ends of the stretchable sleeve are sewn together to lie flat and sandwiched between the back wall of the casing and the wooden backing piece. Alternatively, the stretchable sleeve could be woven to form a continuous sleeve.

It has been found that merely gluing ends of elastic material to the back of the wooden backing piece, results in a failure point. Using a sewn loop of stretchable fabric sandwiched between wooden backing piece and the back wall of the casing and glued under pressure, eliminates the attachment of the stretchable sleeve as a likely point of failure.

DETAILED DESCRIPTION OF THE DRAWINGS

Figure 1:
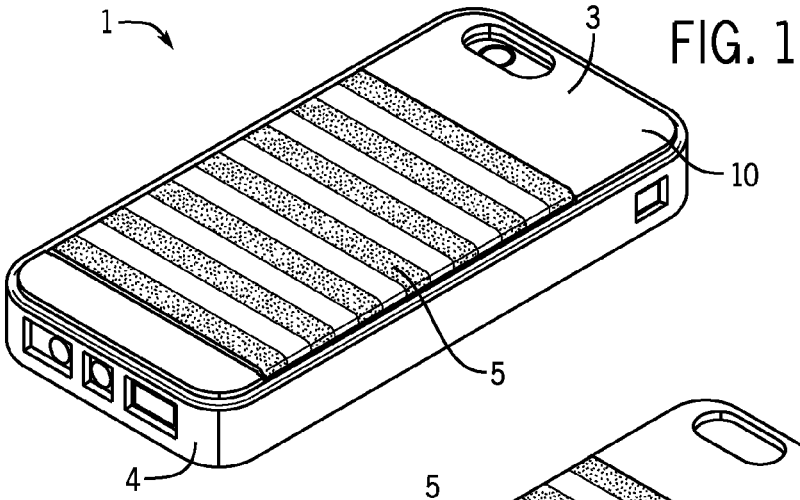
FIG. 1 is a perspective view of a first embodiment of a case wallet constructed in accordance with the invention and showing a cellphone inserted therein.
Figure 2:
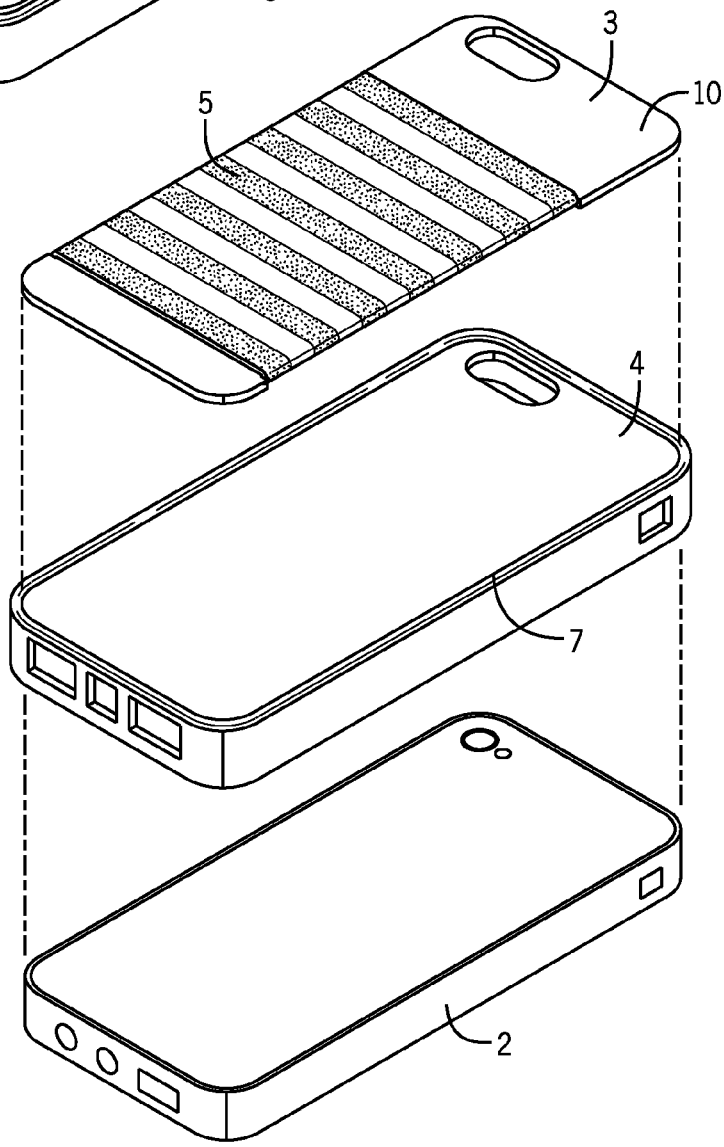
FIG. 2 is a exploded view of the case wallet and cellphone shown in FIG. 1.

FIGS. 1 and 2 show a first embodiment of a case wallet 1 constructed in accordance with the invention. The case wallet 1 has a wooden backing piece 3 having an outer, decorative face 10 and a stretchable sleeve 5 extended over the outer, decorative face 10. The backing piece 3 and stretchable sleeve 5 are permanently connected to a casing 4 for a handheld electronic device 2 (e.g., cellphone). The preferred casing 4 includes a soft (e.g., silicone rubber) bumper 7 around its peripheral sidewall. The backing piece 3 is desirably sized to be commensurate with the dimensions of the bumper 7.

Figure 8:
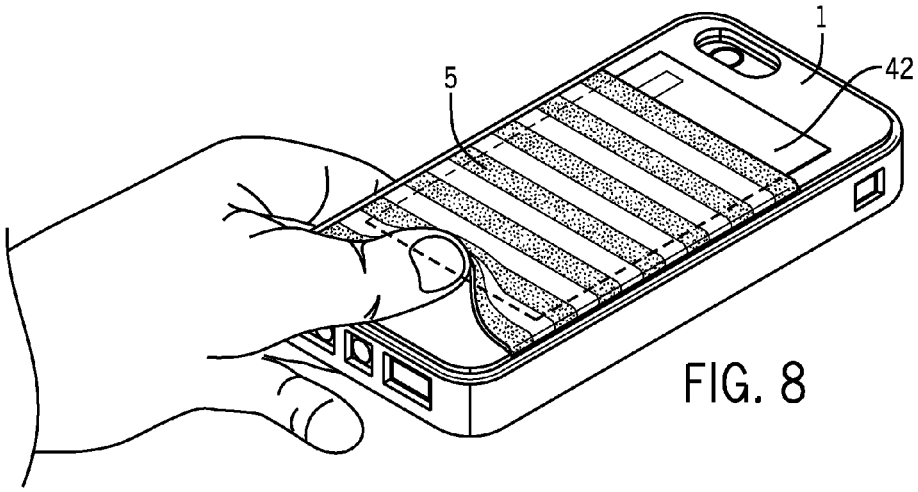
FIG. 8 is a schematic illustration showing use of the case wallet as shown in FIGS. 1 through 7.

The stretchable sleeve 5 is designed to hold personal items, such as credit cards, identification cards, currency, keys, etc. The stretchable sleeve 5 is composed of a material having elasticity so that it can contain and adapt to a variety of personal items. The stretchable sleeve 5 is designed to gently compress the personal item to the backing piece 3 to secure the personal item to the case wallet without damaging the personal item or making the personal item difficult to access. FIG. 8 shows the credit cards being accessible with one hand operation. As exhibited in FIGS. 1-2, 5 and 8, the case wallet 1 has a slim profile and does not add significant bulk to the back of the handheld electronic device 2.

The backing piece 3 should be comprised of a material that is thin enough and light enough to not create significant bulk or weight to the case wallet when the case wallet is attached to a portable electronic device. It is much preferred, as mentioned, that the backing piece 3 be comprised of a thin piece of wood or plywood. Wood is a desirable material because it is lightweight and provides an attractive appearance for the decorative, outer face 110. The wood sheets can be laser cut or milled to an appropriate shape, and can also be branded, inscribed, painted, or stained with a decorative design or trademark.

Figure 6:
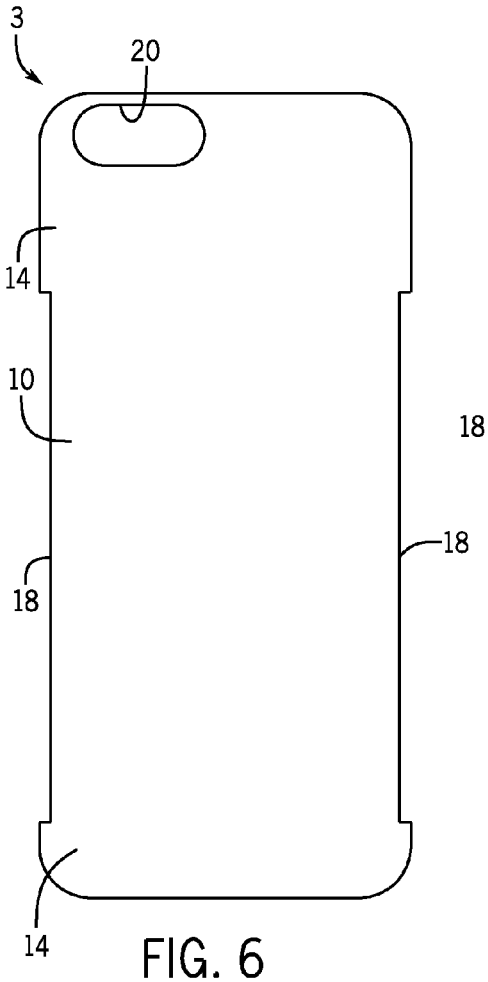
FIG. 6 is a top plan view of the backing piece shown in FIG. 3.
Figure 7:
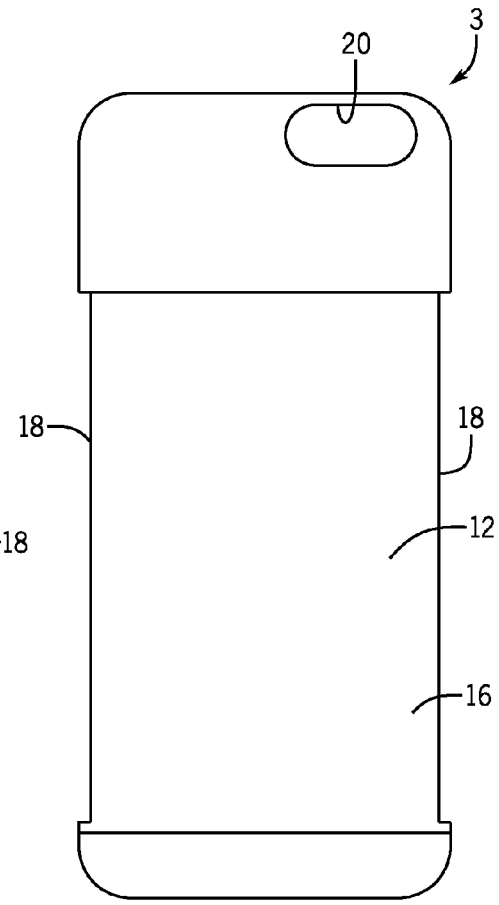
FIG. 7 is a bottom plan view of the backing piece shown in FIG. 3.

Referring to FIGS. 6 and 7, the backing piece 3 includes an outer face 10 (FIG. 6) and an inside face 12 (FIG. 7). The lateral sidewalk of the backing piece 3 include sleeve indentations 18 that are dimensioned to accommodate the stretchable sleeve 5. The inside face 12 of the backing piece 3 also includes a recessed portion 16, see FIG. 7, which is also dimensioned to receive the stretchable sleeve 5. The backing piece 3 further includes an opening 20 for the camera on the backside of the cellphone 2.

Figure 3:
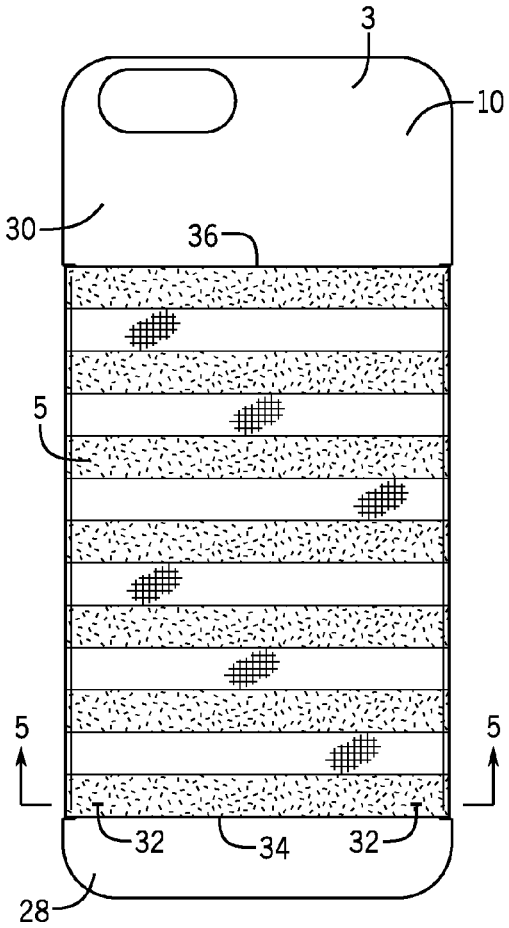
FIG. 3 is a top plan view of a backing piece and stretchable sleeve used in the first embodiment.
Figure 4:
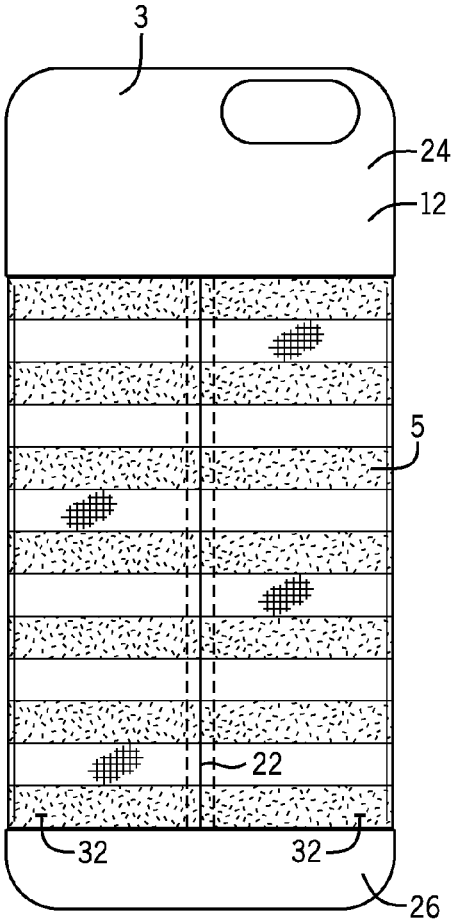
FIG. 4 is a bottom plan view of the backing piece and stretchable sleeve shown in FIG. 3.
Figure 5:
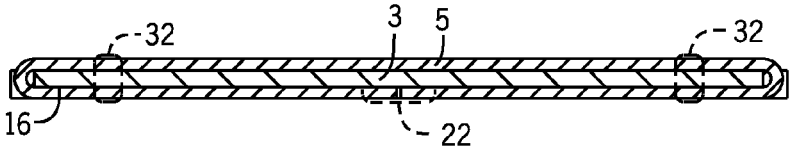
FIG. 5 is a sectional view taken along line 5-5 in FIG. 3.

FIGS. 3 and 4 show the backing piece with the stretchable sleeve 5 wrapped around a backing piece. FIG. 3 shows the outer, decorative face 10 of the backing piece 3 with lower portion 28 and upper portion 30 of the decorative face 10 being exposed for view. FIG. 4, on the other hand, shows the inside face 12 of the backing piece 3. Tacks 32 are sewn through the lower corners of the stretchable sleeve 5 and through the backing piece 3 so that the lower end of the stretchable sleeve 34 is semi-open. The top end 36 of the stretchable sleeve 5 is fully opened, and allows for passage of the storage of standard sized credit cards. The lower end 34 does not allow for the passage of standard sized credit cards because of the tacks 32. FIG. 5 shows a cross-section taken along the line 5-5 in FIG. 3, and illustrates the tacks 32 being sewn through the stretchable sleeve 5 and through the wooden backing piece 3. The ends of the stretchable sleeve are sewn together at seam 22 and, as shown in FIG. 5, are sewn so that they lie flat. FIG. 5 shows the stretchable sleeve 5 having a thickness that is substantially the same as the depth of the recessed portion 16 in the inside surface 12 of the backing piece 3. While this is desirable, practical considerations may require that the fabric from which the stretchable sleeve 5 be made thicker than the depth of the recess 16. Referring again to FIG. 4, the lower portion 26 and the upper 24 of the inside face 112 of the backing piece 3 are permanently adhered directly to the back wall of the case 4 whereas the recessed portion 16 of the inside face 12 of the backing piece 3 and the back wall of the case 4 are permanently adhered together with the stretchable sleeve 5 sandwiched there between. The indentations 18 serve to hold the stretchable sleeve 5 in place, along with the glue.

Figure 9:
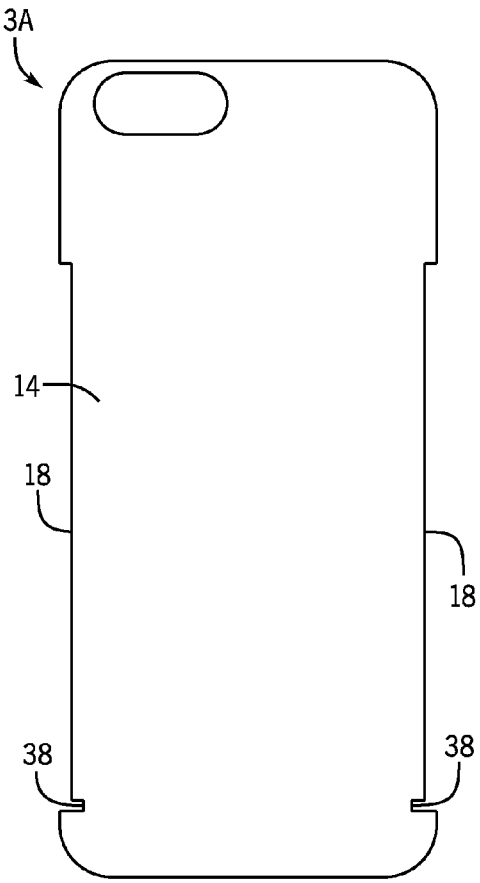
FIG. 9 is a top plan view of a backing piece constructed in accordance with the second embodiment of the invention.
Figure 10:
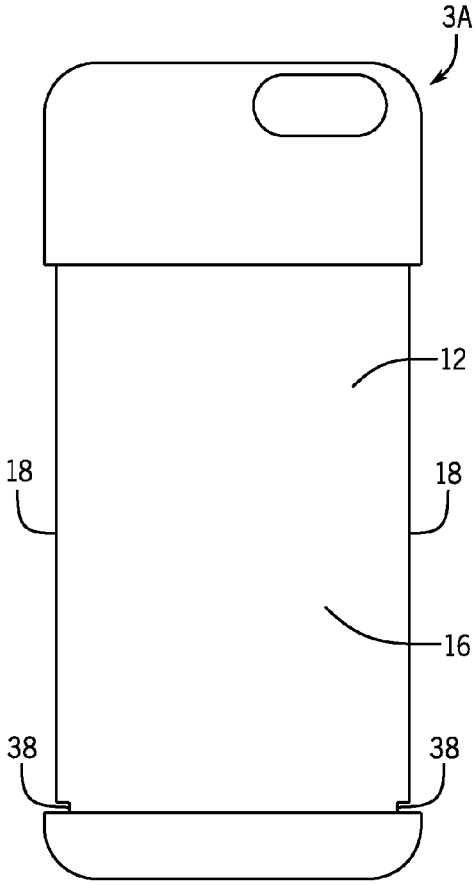
FIG. 10 is a bottom plan view of the backing piece shown in FIG. 9.
Figure 11:
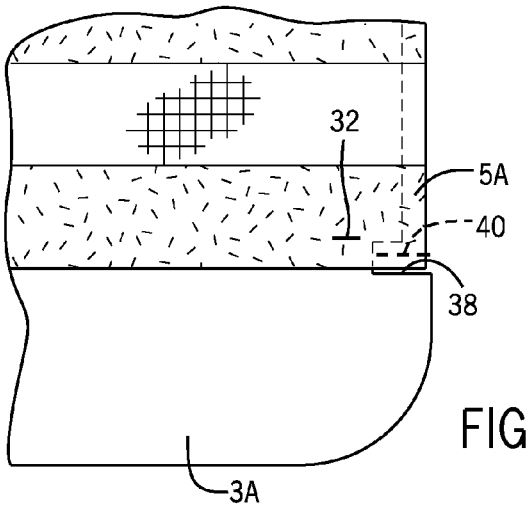
FIG. 11 is a detailed view showing the sleeve being sewn to the backing piece or alternatively through a notch in the backing piece.

In another embodiment depicted in FIGS. 9-11, the backing piece 3A includes notches 38 at the lower end of the sleeve indentations 18. The lower corners 40 of the stretchable sleeve 5A are stitched together at the location of the notches 38 to hold the sleeve in place. The tacks 32 through the sleeve 5 and the backing piece 3 in this embodiment are desirable, e.g. to better hold credit cards, but may not be needed if the notches 38 and stitching 40 is deep enough.

Referring to FIG. 8, a user can push on the bottom side of a stored credit card by pushing a thumb or finger into the bottom portion of the sleeve 5 and pushing up against the credit card 42 with one hand. The "finger push" action can be performed with the same hand that is holding the personal electronic device fitted with the case wallet 1, leaving the other hand free to perform other tasks. As illustrated in FIG. 8, when a user pushes on the bottom of the stretchable sleeve 5 to eject a personal item 42, the stretchable sleeve 5 remains reliably secured to the backing piece 3.

The stretchable sleeve 5 may be comprised of a variety of materials providing sufficient stretch such that personal items can be inserted and removed from the sleeve when the sleeve is attached to the backing piece 3. For example, the stretchable sleeve 5 may be comprised of an elastic mesh, or other material comprised at least partially of elastic. One benefit of the stretchable sleeve 5 is that it has a stretchable form that can accommodate different personal items and/or various amounts of personal items. For example, as mentioned, the stretchable sleeve 5 may be used to hold a single card, such as a credit card, or may hold multiple cards at one time. Other items may also be contained in the stretchable sleeve 5, such as a key or keys, makeup, cash, etc.

The stretchable sleeve 5 can be comprised of fabric of any color or pattern, and thus creates flexibility to create a case wallet 1 that can appeal to many aesthetic tastes. The stretchable sleeve can also be comprised of material having a multitude of different stretch factors. Thus, case wallet 1 can be designed to accommodate a small number of flat items or a larger number of larger items. For example, the case wallet 1 having a sleeve 5 capable of a relatively low amount of stretch would be designed to contain only a few flat items, such as a few credit cards. Alternatively, a case wallet 1 with a sleeve 5 capable of a relatively high amount of stretch may be able to accommodate several items, including larger items like key chains and makeup.

The stretchable sleeve 5 can be any size that can fit onto the backing piece 3. For example, the lateral indentations 18 could extend to the very bottom of the backing piece 3 so that the stretchable sleeve essentially hooks around the bottom of the backing piece 3. Likewise, the indentations 18 and stretchable sleeve 5 could extend over nearly the entire backing piece 3. In most circumstances, it is anticipated that the size of the stretchable sleeve 5 should approximately the same size as the length of a standard sized credit card or identification card, but small enough to avoid covering the camera hole 20 and expose the lower portion 28 and upper portion 30 of the outer wooden face 10.

Referring generally to FIG. 2, the preferred method of constructing the case wallet involves the following steps:

1) Suitable elastic fabric for the stretchable sleeve 5 is made using an elastic webbing loom. The stretchable sleeve 5 when assembled to the case wallet 1 is preferably configured to hold about six (6) standard credit cards tight in the case.
2) Military grade mahogany plywood sheets (1/16 inch or about 1.5 mm thick) are trimmed or shaved to create the recesses 16 that receive the stretchable sleeves 5. The recesses 16 on the inside surface of the wood backing piece 3 are shaved to approximately 1/32 inch or 0.75 mm. Basswood plywood or any other type of wood sheets capable of withstanding the stresses of the wood shaving process can be used instead of military grade mahogany plywood.
3) The wood sheets with the recesses 16 shaved into the inside surface are cut into individual case backing pieces 3 using a laser cutting machine, according to digital cutting and etching patterns for the specific model of wallet case. The sleeve indentations 18 on the lateral sides of the backing pieces 3 are cut at this time as well as entire sidewall of the backing pieces 3. Logos are etched into the wood, using the laser cutting machines at the same time the wood is cut.
4) The wood backing pieces are cleaned and then covered on the exposed side with a clear protective coating.
5) The elastic, stretchable sleeve 5 is cut to size and sewn into a loop with a serger sewing machine. A "loose overlock stitch" is utilized to attach the ends of the fabric into a loop, allowing the fabric to lie flat when the case is assembled.
6) The loop-sewn stretchable sleeve 5 is stretched over the wood backing piece 3, such that it is received in the sleeve indentations on the lateral walls of the backing piece 3 and the recessed portion 16 on the inside surface of the backing piece 3.
7) Two "bar tack" style stitches 32 are sewn at the bottom of the sleeve 5 through the wooden backing piece 3. These stitches 32 are intended to hold the user's cards in place and keep them from slipping out the bottom of the stretchable sleeve 5. The space between the two stitched segments is, however, large enough to allow the user to push their cards out of the top of the stretchable sleeve 5.
8) Permanent adhesive is applied to the back wall of the casing 4 and the top and bottom of the inside surface of the wood backing piece 3 with the stretchable sleeve 5 attached.
9) The wooden backing piece (with the elastic stretchable sleeve 5 attached) is pressed against the back wall of the casing 4.
10) A wooden block is temporarily inserted in the casing to maintain integrity in the compression phase (step #11).
11) Compression: The assembled case with temporary wood block is cured under substantially uniform pressure.

The above described combination of materials and manufacturing method creates a strong case wallet 1 that provides the handheld electronic device (e.g., cellphone) with added protection. The use of military grade plywood sandwiched and permanently glued under pressure with a soft bumper 7, creates a case wallet 1 with stiffness and impact protection.

The use of thin wood is important to keep the case wallet thin because most people carry their cellphone on them at all times. In the exemplary: embodiment, the fabric stretchable sleeve has a thickness of about 1.5 mm and the wooden backing piece has a thickness of about 1.5 mm. The recess on the inside surface of the wooden backing piece is about 0.75 mm deep to reduce the overall thickness. The fabric for stretchable sleeve in the exemplary embodiment is thus thicker than the 0.75 mm recess by about 0.75 mm. Therefore, uniform is pressure is required when gluing the wooden backing piece to the back wall of the casing with the stretchable sleeve sandwiched between.

The recess is preferably made by shaving with a milling process. The thin wood or plywood (e.g., 1/16th inch or 1.5 mm thickness) must be strong enough to withstand the shaving or milling process. Typical, 1.5 mm birch plywood available in hobby shops and many other veneers are not strong enough to standup to the shaving process. However, military grade mahogany plywood and basswood plywood have been found to be strong enough to withstand the shaving process without splintering or tearing apart.

In the present description, certain terms have been used for brevity, clarity and understanding. No unnecessary limitations are to be implied therefrom beyond the requirement of the prior art because such terms are used for descriptive purposes only and are intended to be broadly construed. The devices, systems, and methods described herein may be used alone or in combination with other systems and methods. Various equivalents, alternatives, and modifications are possible within the scope of the disclosed invention,

What is claimed is:

1. A case wallet for a handheld electronic device, the case wallet comprising:

a device casing having a back wall and one or more sidewalk forming a cavity into which a handheld electronic device can be inserted;

a backing piece sized to fit on the back wall of the device casing, the backing piece having an inside face and an outside face, and a top side, bottom side, and two lateral sides;

a sleeve indentation on each lateral side of the backing piece; and a stretchable sleeve that wraps completely around the backing piece and passes through the sleeve indentations, said stretchable sleeve being substantially open on the top side and semi-open on the bottom side of the sleeve and covering a portion of the outside face of the backing piece.

2. The case wallet as recited in claim 1 further comprising sewn in tacks near the lower corners of the stretchable sleeve, the tacks being positioned so that a standard sized credit card cannot fit between the tacks and fall through the bottom side of the sleeve.

3. The case wallet as recited in claim 1 wherein a portion of the inside face of the backing piece corresponding to the sleeve indentations is recessed relative to the remainder of the inside face of the backing piece; and the stretchable sleeve resides at least in part within the recessed portion.

4. The case wallet as recited in claim 3 wherein the outer surface of the back wall of the casing is adhered to the inside face of the backing piece and the stretchable sleeve with permanent adhesive under pressure such that the sleeve is sandwiched between the backing piece and the back wall of the casing.

5. The case wallet as recited in claim 4 wherein the ends of the stretchable sleeve are sewn together to lay flat when sandwiched between the backing piece and the back wall of the casing.

6. The case wallet as recited in claim 1 wherein the device casing further comprises an elastomeric bumper extending around the back wall and around the sides of the backing piece.

7. The case wallet as recited in claim 1 wherein the backing piece includes an opening for a camera lens.

8. The case wallet as recited in claim 1 wherein the backing piece is comprised of wood, and portions of the outside face above and below the stretchable sleeve are exposed to view.

9. The case wallet as recited in claim 8 wherein the wood is mahogany plywood or basswood plywood.

* * * * *

UNITED STATES PATENT AND TRADEMARK OFFICE

CERTIFICATE OF CORRECTION

PATENT NO. : 9,027,746 B2
APPLICATION NO. : 14/488462
DATED : May 12, 2015
INVENTOR(S) : Daniel R. Smith It is certified that error appears in the above-identified patent and that said Letters Patent is hereby corrected as shown below:

In the claims

In claim 1, column 7, line 33, “walk” should instead read --walls--.

Signed and Sealed this
Third Day of November, 2015

Michelle K. Lee

Michelle K. Lee
*Director of the United States Patent and Trademark Office*